US008016050B2

(12) United States Patent
Teodorescu

(10) Patent No.: US 8,016,050 B2
(45) Date of Patent: Sep. 13, 2011

(54) METHODS AND APPARATUSES FOR ESTIMATING DRILL BIT CUTTING EFFECTIVENESS

(75) Inventor: Sorin Gabriel Teodorescu, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 54 days.

(21) Appl. No.: 12/263,660

(22) Filed: Nov. 3, 2008

(65) Prior Publication Data

US 2010/0108380 A1 May 6, 2010

(51) Int. Cl.
*E21B 7/00* (2006.01)
*E21B 44/00* (2006.01)
*E21B 47/00* (2006.01)

(52) U.S. Cl. ..... 175/57; 175/40; 73/152.48; 73/152.46

(58) Field of Classification Search ..... 175/57, 175/40; 73/152.48, 152.46
See application file for complete search history.

(56) References Cited

U.S. PATENT DOCUMENTS 4,715,451 A * 12/1987 Bseisu et al. ..... 175/40
4,884,071 A 11/1989 Howard
4,958,125 A * 9/1990 Jardine et al. ..... 324/162
4,965,774 A * 10/1990 Ng et al. ..... 367/75
5,501,285 A * 3/1996 Lamine et al. ..... 175/27
5,720,355 A * 2/1998 Lamine et al. ..... 175/27
6,459,992 B1 * 10/2002 Freedman et al. ..... 702/6
6,518,756 B1 * 2/2003 Morys et al. ..... 324/303
6,817,425 B2 11/2004 Schultz et al.
6,845,340 B2 * 1/2005 Edie et al. ..... 702/179
6,873,918 B2 * 3/2005 Curless et al. ..... 702/36
6,975,112 B2 * 12/2005 Morys et al. ..... 324/303
7,017,662 B2 3/2006 Schultz et al.
7,035,778 B2 4/2006 Goldman et al.
7,147,066 B2 12/2006 Chen et al.
7,168,506 B2 1/2007 Boucher et al.
7,299,884 B2 * 11/2007 Mathiszik ..... 175/48
7,313,480 B2 * 12/2007 Chen et al. ..... 702/9
7,316,277 B2 1/2008 Jeffryes
7,426,967 B2 * 9/2008 Sugiura ..... 175/38
7,426,969 B2 9/2008 Azar
7,676,326 B2 * 3/2010 Podladchikov et al. ..... 702/11
2004/0245017 A1 * 12/2004 Chen et al. ..... 175/41
2004/0251898 A1 * 12/2004 Morys et al. ..... 324/303
2005/0016769 A1 * 1/2005 Wallace ..... 175/40
2006/0162968 A1 7/2006 Durairajan et al.
2007/0107937 A1 * 5/2007 Sugiura ..... 175/45
2007/0272442 A1 * 11/2007 Pastusek et al. ..... 175/40
2008/0149398 A1 6/2008 Azar
2008/0179108 A1 7/2008 McClain et al.
2009/0078461 A1 * 3/2009 Mansure et al. ..... 175/17
2009/0194332 A1 * 8/2009 Pastusek et al. ..... 175/40
2009/0222209 A1 * 9/2009 Morys ..... 702/9
2010/0097890 A1 * 4/2010 Sullivan et al. ..... 367/82
2010/0108380 A1 * 5/2010 Teodorescu ..... 175/24
2010/0212961 A1 * 8/2010 Teodorescu ..... 175/39

* cited by examiner

*Primary Examiner* — Jennifer H Gay
(74) *Attorney, Agent, or Firm* — TraskBritt

(57) ABSTRACT

A drill bit for drilling a subterranean formation includes a plurality of cutting elements and a shank extending from a bit body. A set of accelerometers disposed in the drill bit include a radial accelerometer and a tangential accelerometer. An annular chamber is formed within the shank. A data evaluation module is disposed in the annular chamber and includes a processor, a memory, and a communication port. The data evaluation module is configured for performing a bit acceleration analysis. The analysis includes sampling acceleration information from the radial accelerometer and the tangential accelerometer over an analysis period and storing the acceleration information in the memory to generate an acceleration history. The acceleration history is analyzed to determine a cutting effectiveness of the cutting elements responsive to changes in the acceleration history. The cutting effectiveness is reported through the communication port.

23 Claims, 12 Drawing Sheets

METHODS AND APPARATUSES FOR ESTIMATING DRILL BIT CUTTING EFFECTIVENESS

TECHNICAL FIELD

Embodiments of the present invention relate generally to drill bits for drilling subterranean formations and, more particularly, to methods and apparatuses for monitoring operating parameters of drill bits during drilling operations.

BACKGROUND

The oil and gas industry expends sizable sums to design cutting tools, such as downhole drill bits including roller cone bits, also termed "rock" bits as well as fixed cutter bits, which have relatively long service lives, with relatively infrequent failure. In particular, considerable sums are expended to design and manufacture roller cone rock bits and fixed cutter bits in a manner that minimizes the opportunity for catastrophic drill bit failure during drilling operations. The loss of a roller cone or a polycrystalline diamond compact (PDC) from a fixed cutter bit during drilling operations can impede the drilling operations and, at worst, necessitate rather expensive fishing operations. If the fishing operations fail, side-track-drilling operations must be performed in order to drill around the portion of the wellbore that includes the lost roller cones or PDC cutters. Typically, during drilling operations, bits are pulled and replaced with new bits even though significant service could be obtained from the replaced bit. These premature replacements of downhole drill bits are expensive, since each trip out of the well prolongs the overall drilling activity by wasting valuable rig time and consumes considerable manpower, but are nevertheless done in order to avoid the far more disruptive and expensive process of, at best, pulling the drillstring and replacing the bit or fishing and side track drilling operations necessary if one or more cones or compacts are lost due to bit failure.

With the ever-increasing need for downhole drilling system dynamic data, a number of "subs" (i.e., a sub-assembly incorporated into the drillstring above the drill bit and used to collect data relating to drilling parameters) have been designed and installed in drillstrings. Unfortunately, these subs cannot provide actual data for what is happening operationally at the bit due to their physical placement above the bit itself.

Data acquisition is conventionally accomplished by mounting a sub in the Bottom Hole Assembly (BHA), which may be several feet to tens of feet away from the bit. Data gathered from a sub this far away from the bit may not accurately reflect what is happening directly at the bit while drilling occurs. Often, this lack of data leads to conjecture as to what may have caused a bit to fail or why a bit performed so well, with no directly relevant facts or data to correlate to the performance of the bit.

Recently, data acquisition systems have been proposed to be installed in the drill bit itself. However, data gathering, storing, and reporting from these systems have been limited. In addition, conventional data gathering in drill bits has not had the capability to adapt to drilling events that may be of interest in a manner allowing more detailed data gathering and analysis when these events occur.

There is a need for a drill bit equipped to gather, store, and analyze long-term data that are related to cutting performance and condition of the drill bit. A drill bit so equipped may; extend useful bit life enabling re-use of a bit in multiple drilling operations, determine when a drill bit is near its end of life and should be changed, and develop drill bit performance data on existing drill bits, which also may be used for developing future improvements to drill bits.

BRIEF SUMMARY OF THE INVENTION

The present invention includes methods and apparatuses to develop information related to cutting performance and condition of the drill bit. As non-limiting examples, the cutting performance and drill bit condition information may be used to determine when a drill bit is near its end of life and should be changed and when drilling operations should be changed to extend the life of the drill bit. The cutting performance and drill bit condition information from an existing drill bit may also be used for developing future improvements to drill bits.

In one embodiment of the invention, a drill bit for drilling a subterranean formation comprises a bit body bearing a plurality of cutting elements and a shank extending from the bit body and adapted for coupling to a drillstring. A set of accelerometers is disposed in the drill bit and includes a radial accelerometer for sensing radial acceleration of the drill bit and a tangential accelerometer for sensing tangential acceleration of the drill bit. An annular chamber is formed within the shank. A data evaluation module is disposed in the annular chamber and includes a processor, a memory, and a communication port. The data evaluation module is configured to record a bit acceleration. The process includes sampling acceleration information from the radial accelerometer and the tangential accelerometer over an analysis period and storing the acceleration information in the memory to generate an acceleration history. The acceleration history is analyzed to determine a cutting effectiveness of the plurality of cutting elements responsive to changes in the acceleration history. The cutting effectiveness is reported through the communication port.

Another embodiment of the invention is a method that includes periodically collecting sensor data by sampling over an analysis period at least one tangential accelerometer disposed in a drill bit and at least one radial accelerometer disposed in the drill bit. The method also includes processing the sensor data in the drill bit to develop a Root Mean Square (RMS) radial acceleration history and a RMS tangential acceleration history. The RMS radial acceleration history and the RMS tangential acceleration history are compared to determine a cross point when the RMS radial acceleration history will exceed the RMS tangential acceleration history. The cross point is reported as a dull state.

Another embodiment of the invention is a method that includes collecting acceleration information by periodically sampling at least one accelerometer over an analysis period. The acceleration information is processed in the drill bit to develop a Root Mean Square (RMS) acceleration history. The RMS acceleration history is analyzed to determine a time-varying slope of the RMS acceleration history over the analysis period and a cutting effectiveness of the drill bit correlated to the time-varying slope is reported.

DETAILED DESCRIPTION OF THE INVENTION

The present invention includes methods and apparatuses to develop information related to cutting performance and condition of the drill bit. As non-limiting examples, the cutting performance and drill bit condition information may be used to determine when a drill bit is near its end of life and should be changed and when drilling operations should be changed to extend the life of the drill bit. The cutting performance and drill bit condition information from an existing drill bit may also be used for developing future improvements to drill bits.

Figure 1:
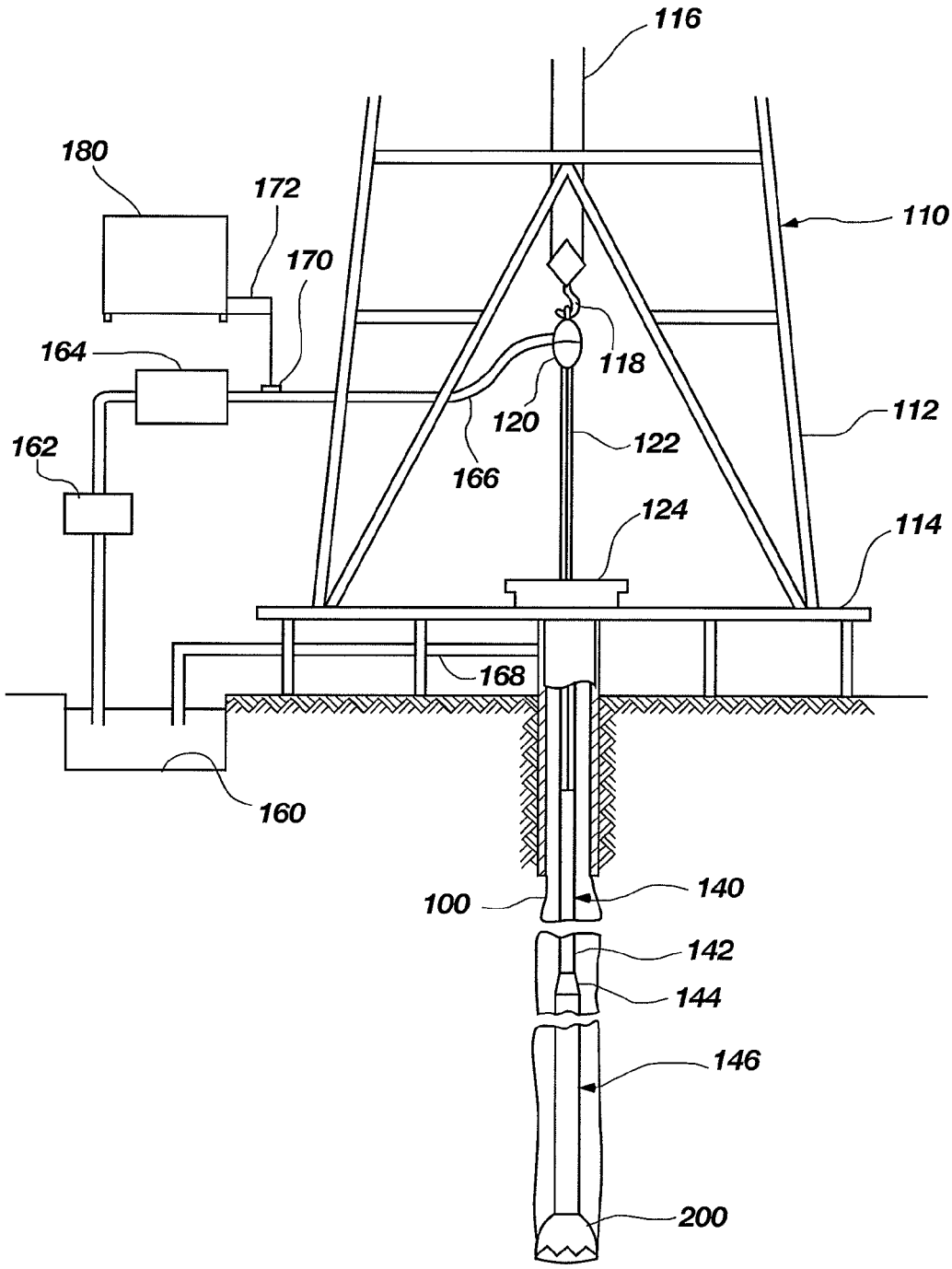
FIG. 1 illustrates a conventional drilling rig for performing drilling operations.

FIG. 1 depicts an example of conventional apparatus for performing subterranean drilling operations. Drilling rig 110 includes a derrick 112, a derrick floor 114, a draw works 116, a hook 118, a swivel 120, a Kelly joint 122, and a rotary table 124. A drillstring 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drillstring 140 may include a measurement-while-drilling (MWD) logging subassembly and cooperating mud pulse telemetry data transmission subassembly, which are collectively referred to as an MWD communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial central bore in the drillstring 140. Eventually, it exits through apertures or nozzles, which are located in a drill bit 200, which is connected to the lowermost portion of the drillstring 140 below drill collar section 144. The drilling mud flows back up through an annular space between the outer surface of the drillstring 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The MWD communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 146. Mud pulses that define the data propagated to the surface are produced by equipment conventionally located within the MWD communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown) which may be located near a bottom hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a backup for the turbine-driven generator.

Figure 2:
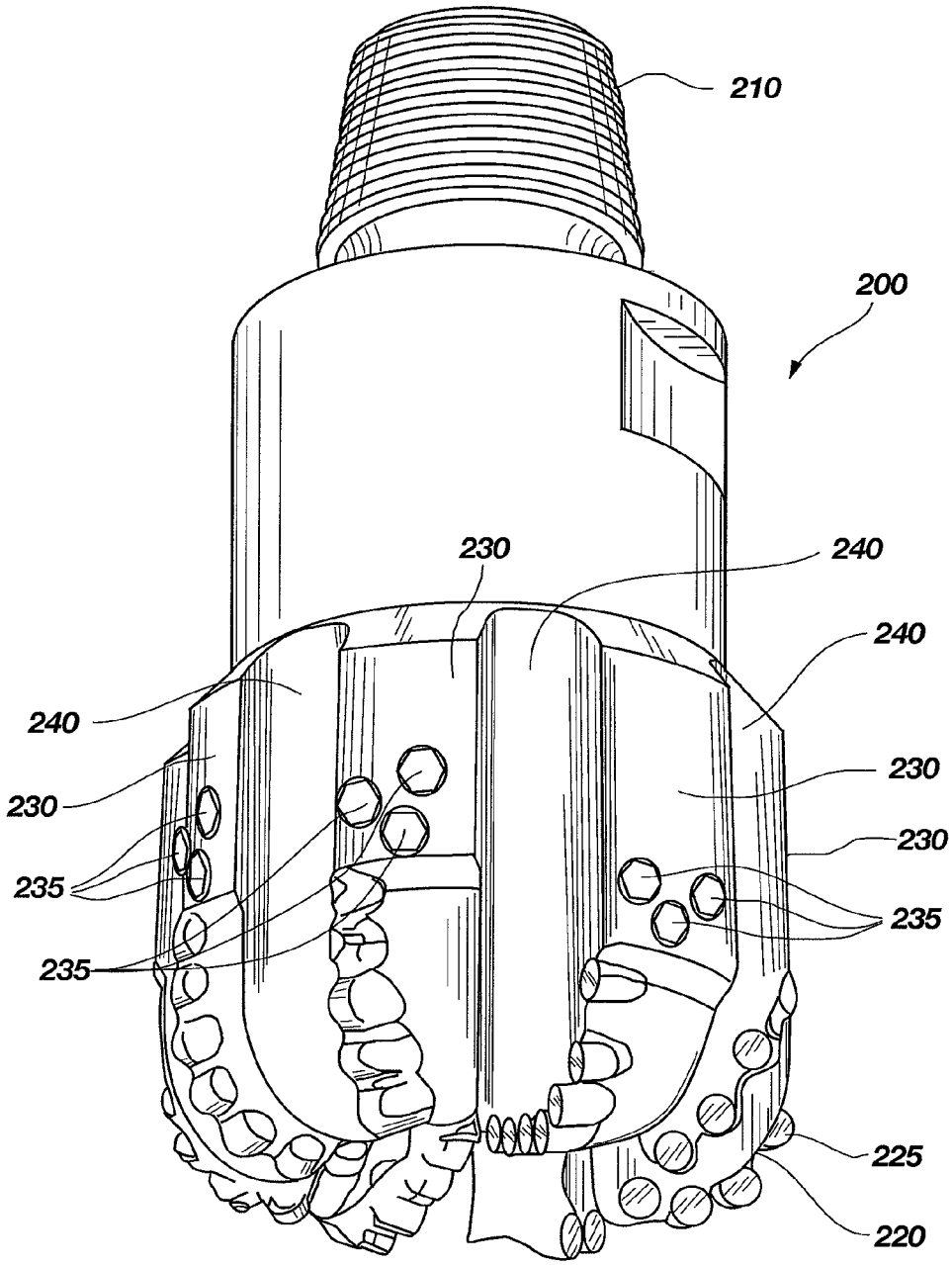
FIG. 2 is a perspective view of a conventional matrix-type rotary drag bit.

FIG. 2 is a perspective view of an example of a drill bit 200 of a fixed-cutter, or so-called "drag" bit, variety. Conventionally, the drill bit 200 includes threads at a shank 210 at the upper extent of the drill bit 200 for connection into the drillstring 140 (FIG. 1). At least one blade 220 (a plurality shown) at a generally opposite end from the shank 210 may be provided with a plurality of natural or synthetic diamonds (polycrystalline diamond compact) cutters 225, arranged along the rotationally leading faces of the blades 220 to effect efficient disintegration of formation material as the drill bit 200 is rotated in the borehole 100 under applied weight on bit (WOB). A gage pad surface 230 extends upwardly from each of the blades 220, is proximal to, and generally contacts the sidewall of the borehole 100 (FIG. 1) during drilling operation of the drill bit 200. A plurality of channels 240, termed "junkslots," extend between the blades 220 and the gage pad surfaces 230 to provide a clearance area for removal of formation chips formed by the cutters 225.

A plurality of gage inserts 235 are provided on the gage pad surfaces 230 of the drill bit 200. Shear cutting gage inserts 235 on the gage pad surfaces 230 of the drill bit 200 provide the ability to actively shear formation material at the sidewall of the borehole 100 and to provide improved gage-holding ability in earth-boring bits of the fixed cutter variety. The drill bit 200 is illustrated as a PDC ("polycrystalline diamond compact") bit, but the gage inserts 235 may be equally useful in other fixed cutter or drag bits that include gage pad surfaces 230 for engagement with the sidewall of the borehole 100.

Those of ordinary skill in the art will recognize that the present invention may be embodied in a variety of drill bit types. The present invention possesses utility in the context of a tricone or roller cone rotary drill bit or other subterranean drilling tools, as known in the art, that may employ nozzles for delivering drilling mud to a cutting structure during use. Accordingly, as used herein, the term "drill bit" includes and encompasses any and all rotary bits, including core bits, rollercone bits, fixed cutter bits; including PDC, natural diamond, thermally stable produced (TSP) synthetic diamond, and diamond impregnated bits, without limitation, eccentric bits, bicenter bits, reamers, reamer wings, as well as other earth-boring tools configured for acceptance of an electronics module 290.

Figure 3A:
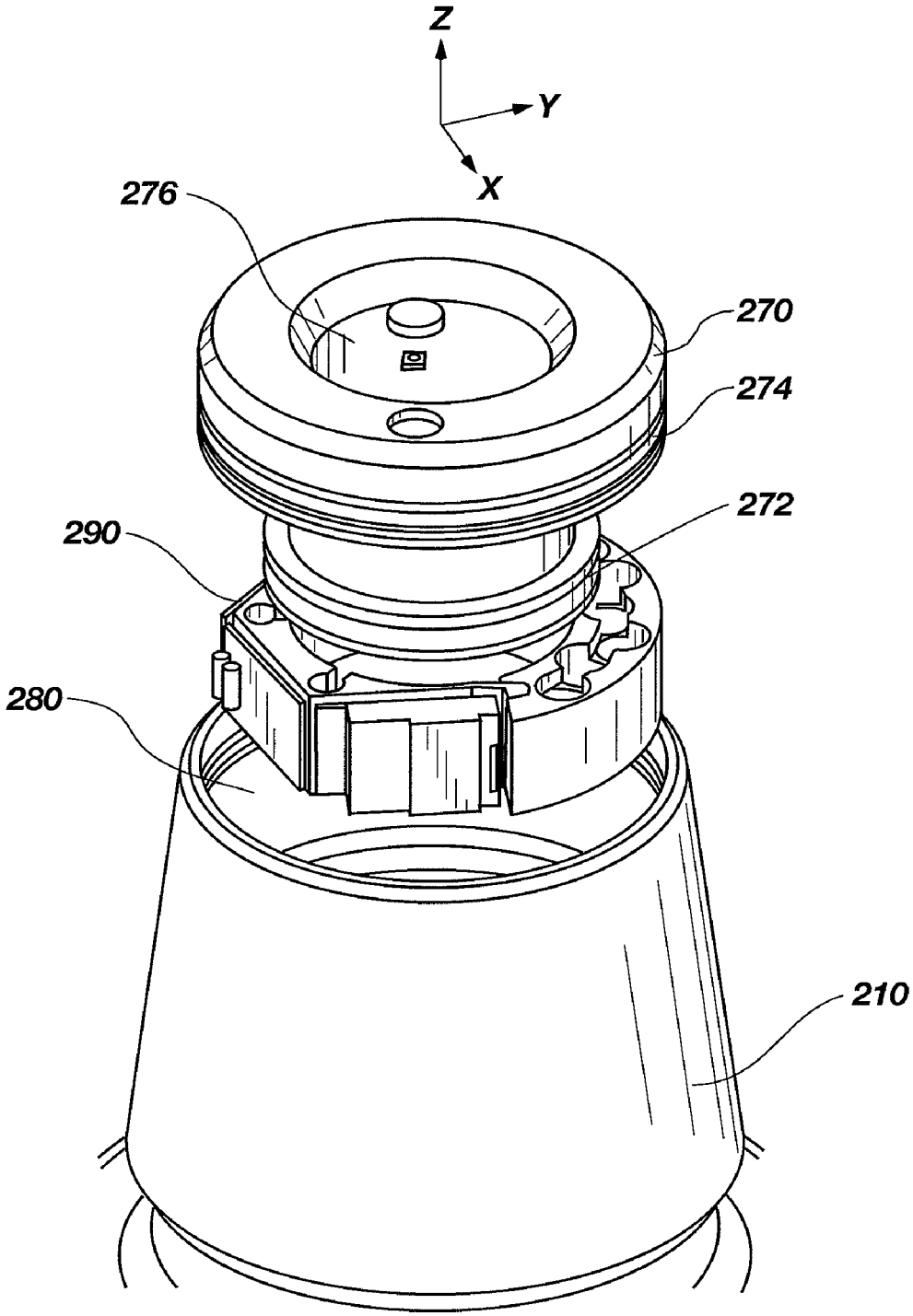
FIG. 3A is a perspective view of a shank, receiving an embodiment of an electronics module with an end-cap.
Figure 3B:
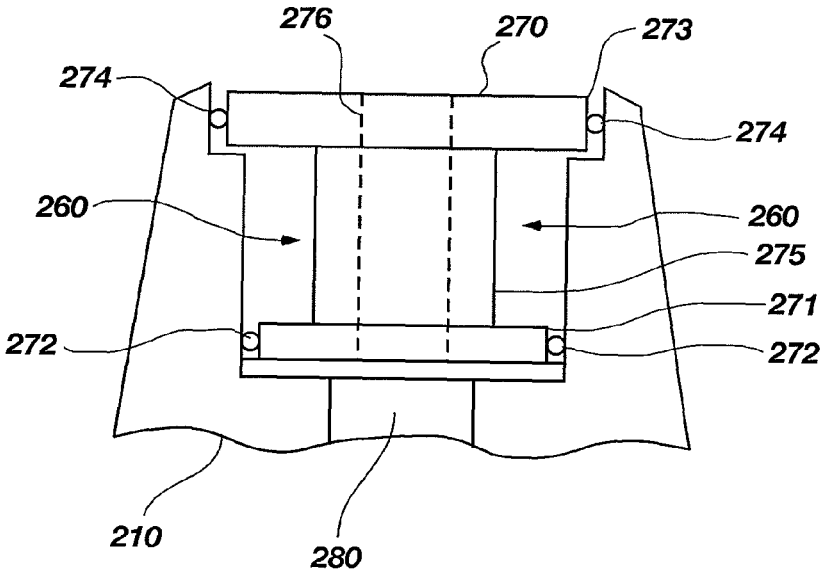
FIG. 3B is a cross-sectional view of a shank and an end-cap.

FIGS. 3A and 3B illustrate an embodiment of a shank 210 secured to a drill bit 200 (not shown), an end-cap 270, and an embodiment of an electronics module 290 (not shown in FIG. 3B). The shank 210 includes a central bore 280 formed through the longitudinal axis of the shank 210. In conventional drill bits 200, this central bore 280 is configured for allowing drilling mud to flow therethrough. In the present invention, at least a portion of the central bore 280 is given a diameter sufficient for accepting the electronics module 290 configured in a substantially annular ring, yet without substantially affecting the structural integrity of the shank 210. Thus, the electronics module 290 may be placed down in the central bore 280, about the end-cap 270, which extends through the inside diameter of the annular ring of the electronics module 290 to create a fluid tight annular chamber 260 (FIG. 3B) with the wall of central bore 280 and seal the electronics module 290 in place within the shank 210.

The end-cap 270 includes a cap bore 276 formed therethrough, such that the drilling mud may flow through the end-cap 270, through the central bore 280 of the shank 210 to the other side of the shank 210, and then into the body of drill bit 200. In addition, the end-cap 270 includes a first flange 271 including a first sealing ring 272, near the lower end of the end-cap 270, and a second flange 273 including a second sealing ring 274, near the upper end of the end-cap 270.

FIG. 3B is a cross-sectional view of the end-cap 270 disposed in the shank without the electronics module 290 (FIG. 4), illustrating the annular chamber 260 formed between the first flange 271, the second flange 273, the end-cap body 275, and the walls of the central bore 280. The first sealing ring 272 and the second sealing ring 274 form a protective, fluid tight, seal between the end-cap 270 and the wall of the central bore 280 to protect the electronics module 290 (FIG. 4) from adverse environmental conditions. The protective seal formed by the first sealing ring 272 and the second sealing ring 274 may also be configured to maintain the annular chamber 260 at approximately atmospheric pressure.

In the embodiment shown in FIGS. 3A and 3B, the first sealing ring 272 and the second sealing ring 274 are formed of a material suitable for high-pressure, high temperature environment, such as, for example, a Hydrogenated Nitrile Butadiene Rubber (HNBR) O-ring in combination with a PEEK back-up ring. In addition, the end-cap 270 may be secured to the shank 210 with a number of connection mechanisms such as, for example, a secure press-fit using first and second sealing rings 272 and 274, respectively, a threaded connection, an epoxy connection, a shape-memory retainer, welded, and brazed. It will be recognized by those of ordinary skill in the art that the end-cap 270 may be held in place quite firmly by a relatively simple connection mechanism due to differential pressure and downward mud flow during drilling operations.

An electronics module 290 configured as shown in the embodiment of FIG. 3A may be configured as a flex-circuit board, enabling the formation of the electronics module 290 into the annular ring suitable for disposition about the end-cap 270 and into the central bore 280.

Figure 4:
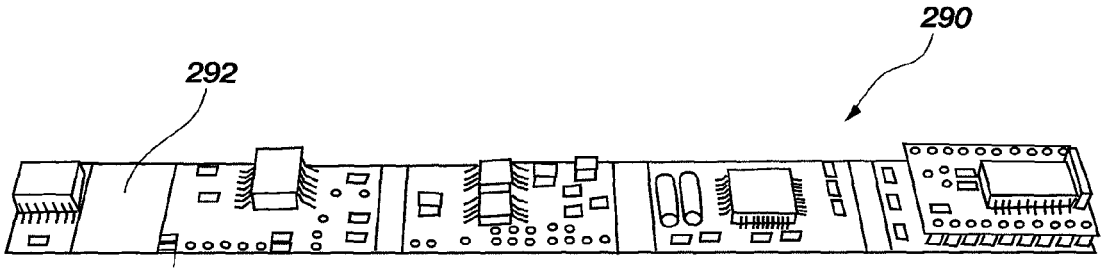
FIG. 4 is a drawing of an embodiment of an electronics module configured as a flex-circuit board enabling formation into an annular ring suitable for disposition in the shank of FIGS. 3A and 3B.

FIG. 4 illustrates this flex-circuit board embodiment of the electronics module 290 in a flat, uncurled configuration. The flex-circuit board 292 includes a high-strength reinforced backbone (not shown) to provide acceptable transmissibility of acceleration effects to sensors, such as accelerometers. In addition, other areas of the flex-circuit board 292 bearing non-sensor electronic components may be attached to the end-cap 270 in a manner suitable for at least partially attenuating the acceleration effects experienced by the drill bit 200 during drilling operations using a material such as a visco-elastic adhesive.

Figure 5A:
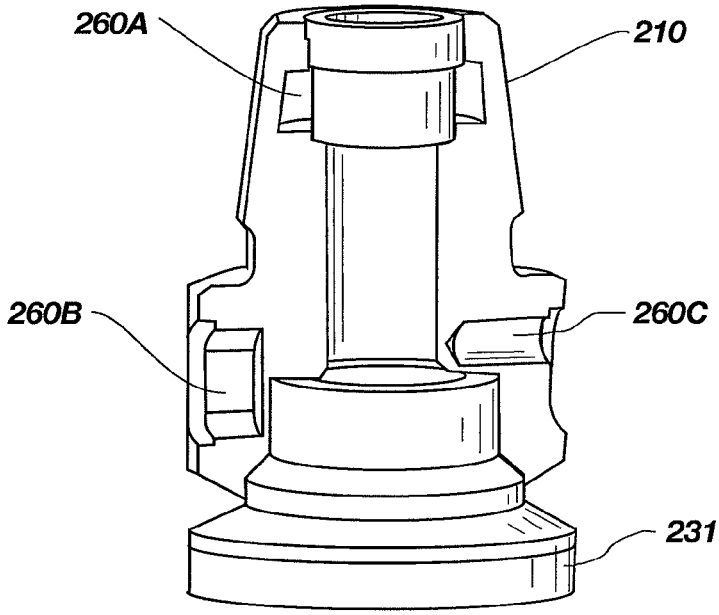
FIGS. 5A-5E are perspective views of a drill bit illustrating example locations in the drill bit, wherein an electronics module, sensors, or combinations thereof may be located.

FIGS. 5A-5E are perspective views of portions of a drill bit 200 illustrating examples of locations in the drill bit wherein an electronics module 290 (FIG. 4), sensors 340 and 370 (FIG. 6), or combinations thereof may be located. FIG. 5A illustrates the shank 210 of FIG. 3 secured to a bit body 231. In addition, the shank 210 includes an annular race 260A formed in the central bore 280. This annular race 260A may allow expansion of the electronics module 290 into the annular race 260A as the end-cap 270 (FIGS. 3A and 3B) is disposed into position.

FIG. 5A also illustrates two other alternative locations for the electronics module 290, sensors 340, or combinations thereof. An oval cut out 260B, located behind the oval depression (may also be referred to as a torque slot) used for stamping the drill bit with a serial number may be milled out to accept the electronics. This area could then be capped and sealed to protect the electronics. Alternatively, a round cut out 260C located in the oval depression used for stamping the drill bit may be milled out to accept the electronics, then may be capped and sealed to protect the electronics.

Figure 5B:
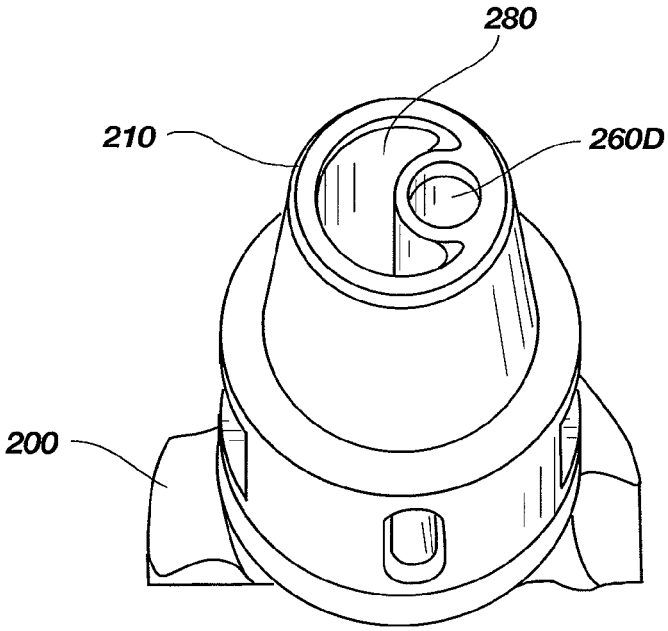

FIG. 5B illustrates an alternative configuration of the shank 210. A circular depression 260D may be formed in the shank 210 and the central bore 280 formed around the circular depression 260D, allowing transmission of the drilling mud. The circular depression 260D may be capped and sealed to protect the electronics within the circular depression 260D.

Figure 5C:
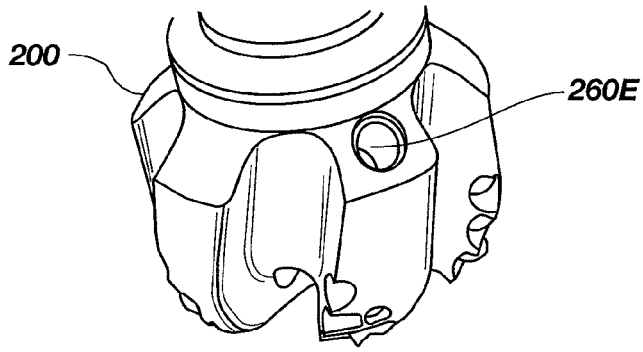
Figure 5D:
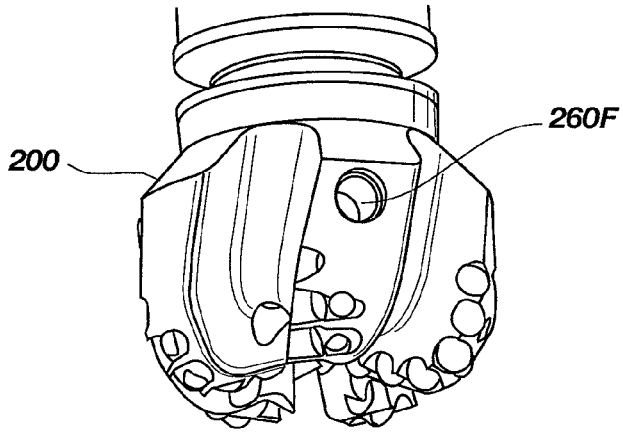
Figure 5E:
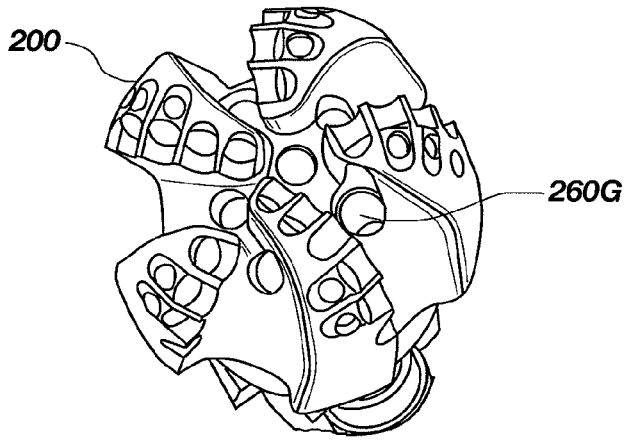

FIGS. 5C-5E illustrate circular depressions (260E, 260F, 260G) formed in locations on the drill bit 200. These locations offer a reasonable amount of room for electronic components while still maintaining acceptable structural strength in the blade.

An electronics module may be configured to perform a variety of functions. One embodiment of an electronics module 290 may be configured as a data evaluation module, which is configured for sampling data in different sampling modes, sampling data at different sampling frequencies, and analyzing data.

Figure 6:
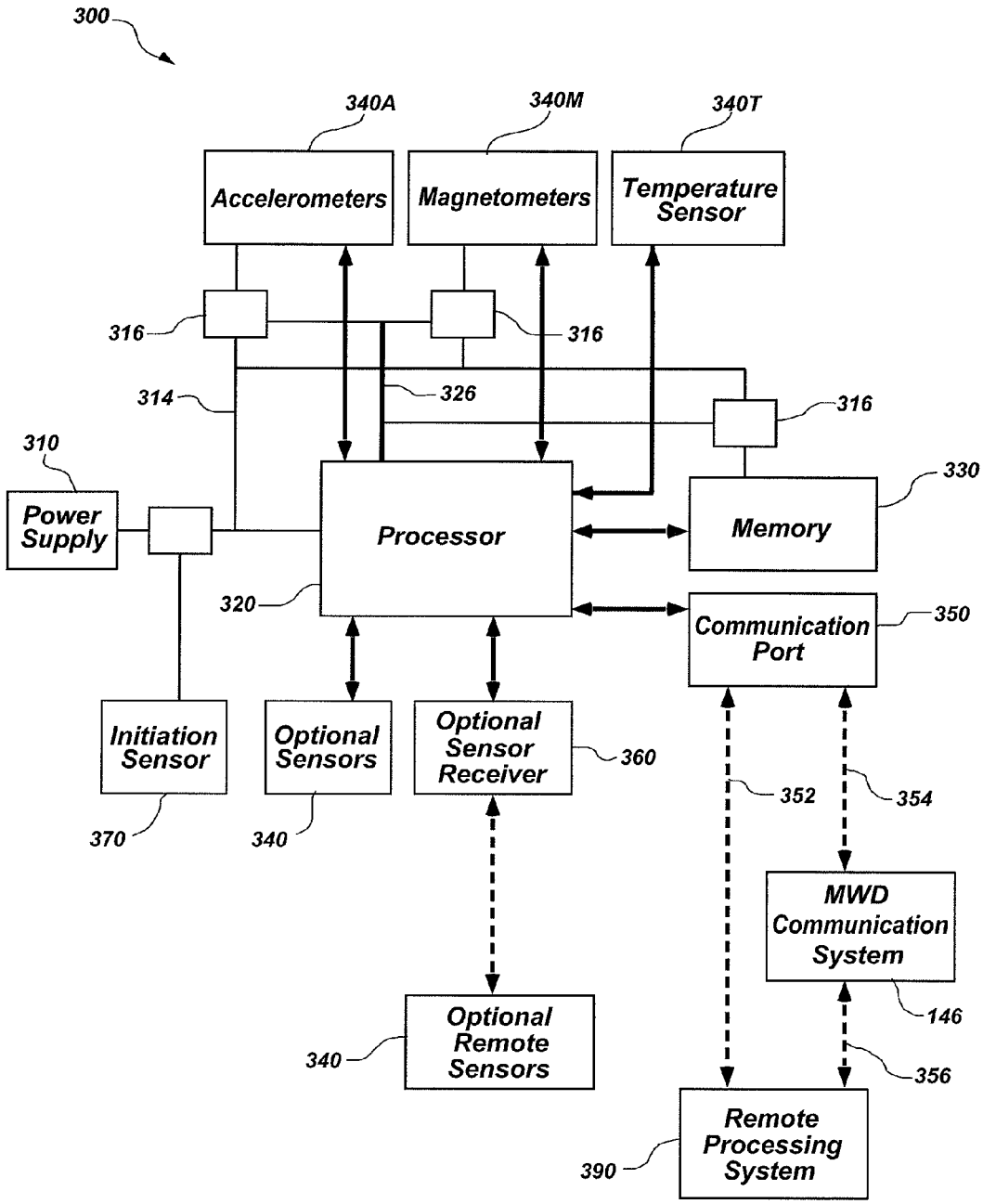
FIG. 6 is a block diagram of an embodiment of a data evaluation module according to the present invention.

FIG. 6 illustrates an embodiment of a data evaluation module 300. The data evaluation module 300 includes a power supply 310, a processor 320, a memory 330, and at least one sensor 340 configured for measuring a plurality of physical parameters related to a drill bit state, which may include drill bit condition, drilling operation conditions, and environmental conditions proximate the drill bit. In the embodiment of FIG. 6, the sensors 340 include a plurality of accelerometers 340A, a plurality of magnetometers 340M, and a temperature sensor 340T.

The magnetometers 340M of the FIG. 6 embodiment, when enabled and sampled, provide a measure of the orientation of the drill bit 200 along at least one of the three orthogonal axes relative to the earth's magnetic field. The data evaluation module 300 may include additional magnetometers 340M to provide a redundant system, wherein various magnetometers 340M may be selected, or deselected, in response to fault diagnostics performed by the processor 320.

The temperature sensor 340T may be used to gather data relating to the temperature of the drill bit 200, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 may be included as part of the data evaluation module 300. Some non-limiting examples of sensors, which may be useful in the present invention, are strain sensors at various locations of the drill bit, temperature sensors at various locations of the drill bit, mud (drilling fluid) pressure sensors to measure mud pressure internal to the drill bit, and borehole pressure sensors to measure hydrostatic pressure external to the drill bit. Sensors may also be implemented to detect mud properties, such as, for example, sensors to detect conductivity or impedance to both alternating current and direct current, sensors to detect influx of fluid from the hole when mud flow stops, sensors to detect changes in mud properties, and sensors to characterize mud properties, such as synthetic-based and water-based mud.

These optional sensors 340 may include sensors 340 that are integrated with and configured as part of the data evaluation module 300. These sensors 340 may also include optional remote sensors 340 placed in other areas of the drill bit 200, or above the drill bit 200 in the bottom hole assembly. The optional sensors 340 may communicate using a direct-wired connection, or through an optional sensor receiver 360. The sensor receiver 360 is configured to enable wireless remote sensor communication across limited distances in a drilling environment, as are known by those of ordinary skill in the art.

The memory 330 may be used for storing sensor data, signal processing results, long-term data storage, and computer instructions for execution by the processor 320. Portions of the memory 330 may be located external to the processor 320 and portions may be located within the processor 320. The memory 330 may be Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 6 embodiment, the memory 330 is a combination of SRAM in the processor (not shown), Flash memory 330 in the processor 320, and external Flash memory 330. Flash memory may be desirable for low power operation and ability to retain information when no power is applied to the memory 330.

A communication port 350 may be included in the data evaluation module 300 for communication to external devices such as the MWD communication system 146 and a remote processing system 390. The communication port 350 may be configured for a direct communication link 352 to the remote processing system 390 using a direct wire connection or a wireless communication protocol, such as, by way of example only, infrared, BLUETOOTH®, and 802.11a/b/g protocols. Using the direct communication, the data evaluation module 300 may be configured to communicate with a remote processing system 390 such as, for example, a computer, a portable computer, and a personal digital assistant (PDA) when the drill bit 200 is not downhole. Thus, the direct communication link 352 may be used for a variety of functions, such as, for example, to download software and software upgrades, to enable setup of the data evaluation module 300 by downloading configuration data, and to upload sample data and analysis data. The communication port 350 may also be used to query the data evaluation module 300 for information related to the drill bit 200, such as, for example, bit serial number, data evaluation module serial number, software version, total elapsed time of bit operation, and other long term drill bit data, which may be stored in the NVRAM.

The communication port 350 may also be configured for communication with the MWD communication system 146 in a bottom hole assembly via a wired or wireless communication link 354 and protocol configured to enable remote communication across limited distances in a drilling environment as are known by those of ordinary skill in the art. One available technique for communicating data signals to an adjoining subassembly in the drillstring 140 (FIG. 1) is depicted, described, and claimed in U.S. Pat. No. 4,884,071 entitled "Wellbore Tool With Hall Effect Coupling," which issued on Nov. 28, 1989 to Howard and the disclosure of which is incorporated herein by reference.

The MWD communication system 146 may, in turn, communicate data from the data evaluation module 300 to a remote processing system 390 using mud pulse telemetry 356 or other communication means suitable for communication across the relatively large distances encountered in a drilling operation.

The processor 320 in the embodiment of FIG. 6 is configured for processing, analyzing, and storing collected sensor data. For sampling of the analog signals from the various sensors 340, the processor 320 of this embodiment includes a digital-to-analog converter (DAC). However, those of ordinary skill in the art will recognize that the present invention may be practiced with one or more external DACs in communication between the sensors 340 and the processor 320. In addition, the processor 320 in the embodiment includes internal SRAM and NVRAM. However, those of ordinary skill in the art will recognize that the present invention may be practiced with memory 330 that is only external to the processor 320 as well as in a configuration using no external memory 330 and only memory 330 internal to the processor 320.

The embodiment of FIG. 6 uses battery power as the operational power supply 310. Battery power enables operation without consideration of connection to another power source while in a drilling environment. However, with battery power, power conservation may become a significant consideration in the present invention. As a result, a low power processor 320 and low power memory 330 may enable longer battery life. Similarly, other power conservation techniques may be significant in the present invention.

The embodiment of FIG. 6, illustrates power controllers 316 for gating the application of power to the memory 330, the accelerometers 340A, and the magnetometers 340M. Using these power controllers 316, software running on the processor 320 may manage a power control bus 326 including control signals for individually enabling a voltage signal 314 to each component connected to the power control bus 326. While the voltage signal 314 is shown in FIG. 6 as a single signal, it will be understood by those of ordinary skill in the art that different components may require different voltages. Thus, the voltage signal 314 may be a bus including the voltages necessary for powering the different components.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, one example of a Cartesian coordinate system, shown in FIG. 3A, defines a z-axis along the longitudinal axis about which the drill bit 200 rotates, an x-axis perpendicular to the z-axis, and a y-axis perpendicular to both the z-axis and the x-axis, to form the three orthogonal axes of a typical Cartesian coordinate system. Because the data evaluation module 300 may be used while the drill bit 200 is rotating and with the drill bit 200 in other than vertical orientations, the coordinate system may be considered a rotating Cartesian coordinate system with a varying orientation relative to the fixed surface location of the drilling rig 110 (FIG. 1).

The accelerometers 340A of the FIG. 6 embodiment, when enabled and sampled, provide a measure of acceleration of the drill bit 200 along at least one of the three orthogonal axes. The data evaluation module 300 may include additional accelerometers 340A to provide a redundant system, wherein various accelerometers 340A may be selected, or deselected, in response to fault diagnostics performed by the processor 320. Furthermore, additional accelerometers may be used to determine additional information about bit dynamics and assist in distinguishing lateral accelerations from angular accelerations.

Figure 7:
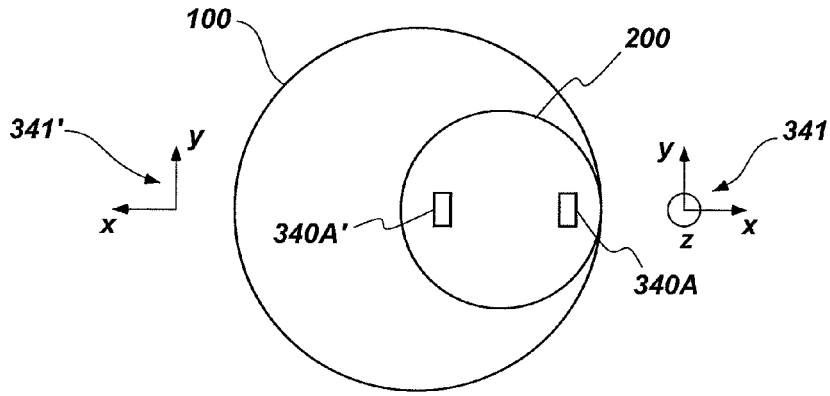
FIG. 7 illustrates placement of multiple accelerometers.

FIG. 7 is a top view of a drill bit 200 within a borehole 100. As can be seen, FIG. 7 illustrates the drill bit 200 offset within the borehole 100, which may occur due to bit behavior other than simple rotation around a rotational axis. FIG. 7 also illustrates placement of multiple accelerometers with a first set of accelerometers 340A positioned at a first location. A second set of accelerometers 340A' positioned at a second location within the bit body may also be included. By way of example, the first set of accelerometers 340A includes a first coordinate system 341 with x, y, and z accelerometers, while the second set of accelerometers 340A' includes a second coordinate system 341' with x and y accelerometers. These axes of the coordinate systems and may also be referred to herein as axial (z-axis), tangential (y-axis), and radial (x-axis). Thus, there may be one or more radial accelerometers, one or more tangential accelerometers, and an axial accelerometer. Of course, other embodiments may include three coordinates in the second set of accelerometers as well as other configurations and orientations of accelerometers alone or in multiple coordinate sets.

With the placement of a second set of accelerometers at a different location on the drill bit, differences between the accelerometer sets may be used to distinguish lateral accelerations from angular accelerations. For example, if the two sets of accelerometers are both placed at the same radius from the rotational center of the drill bit 200 and the drill bit 200 is only rotating about that rotational center, then the two accelerometer sets will experience the same angular rotation. However, the drill bit may be experiencing more complex behavior, such as, for example, bit whirl (forward or backward), bit walking, and lateral vibration. These behaviors include some type of lateral motion in combination with the angular motion. For example, as illustrated in FIG. 7, the drill bit 200 may be rotating about its rotational axis and at the same time, walking around the larger circumference of the borehole 100. In these types of motion, the two sets of accelerometers disposed at different places will experience different accelerations. With the appropriate signal processing and mathematical analysis, the lateral accelerations and angular accelerations may be more easily determined with the additional accelerometers.

Furthermore, if initial conditions are known or estimated, bit velocity profiles and bit trajectories may be inferred by mathematical integration of the accelerometer data using conventional numerical analysis techniques.

Figure 8:
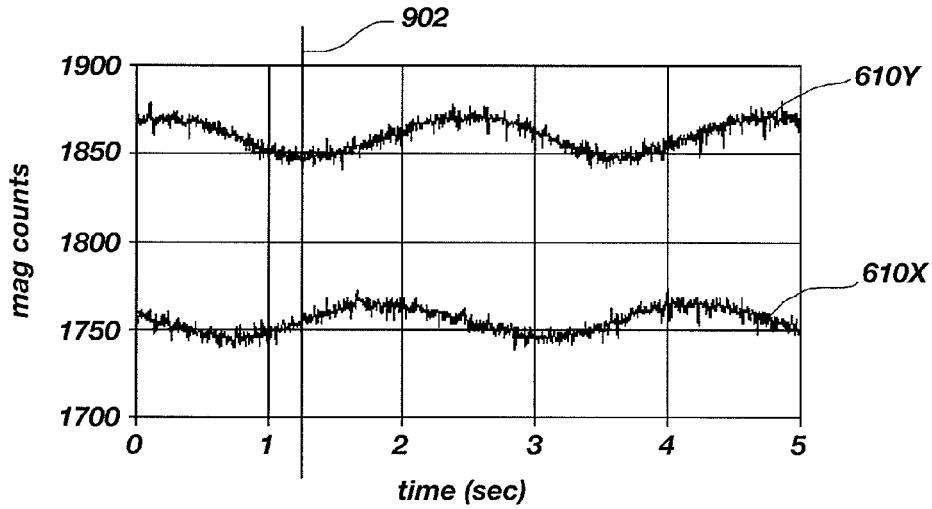
FIG. 8 illustrates examples of data sampled from magnetometer sensors along two axes of a rotating Cartesian coordinate system.

Referring to FIG. 8, magnetometer samples histories are shown for X magnetometer samples 610X and Y magnetometer samples 610Y. Looking at sample point 902, it can be seen that the Y magnetometer samples 610Y are near a minimum and the X magnetometer samples 610X are at a phase of about 90 degrees. By tracking the history of these samples, the software can detect when a complete revolution has occurred. For example, the software can detect when the X magnetometer samples 610X have become positive (i.e., greater than a selected value) as a starting point of a revolution. The software can then detect when the Y magnetometer samples 610Y have become positive (i.e., greater than a selected value) as an indication that revolutions are occurring. Then, the software can detect the next time the X magnetometer samples 610X become positive, indicating a complete revolution. As a non-limiting example, each time a revolution occurs, the logging operation may update various logging variables, perform data compression operations, communicate data, communicate events, or combinations thereof.

Figure 9:
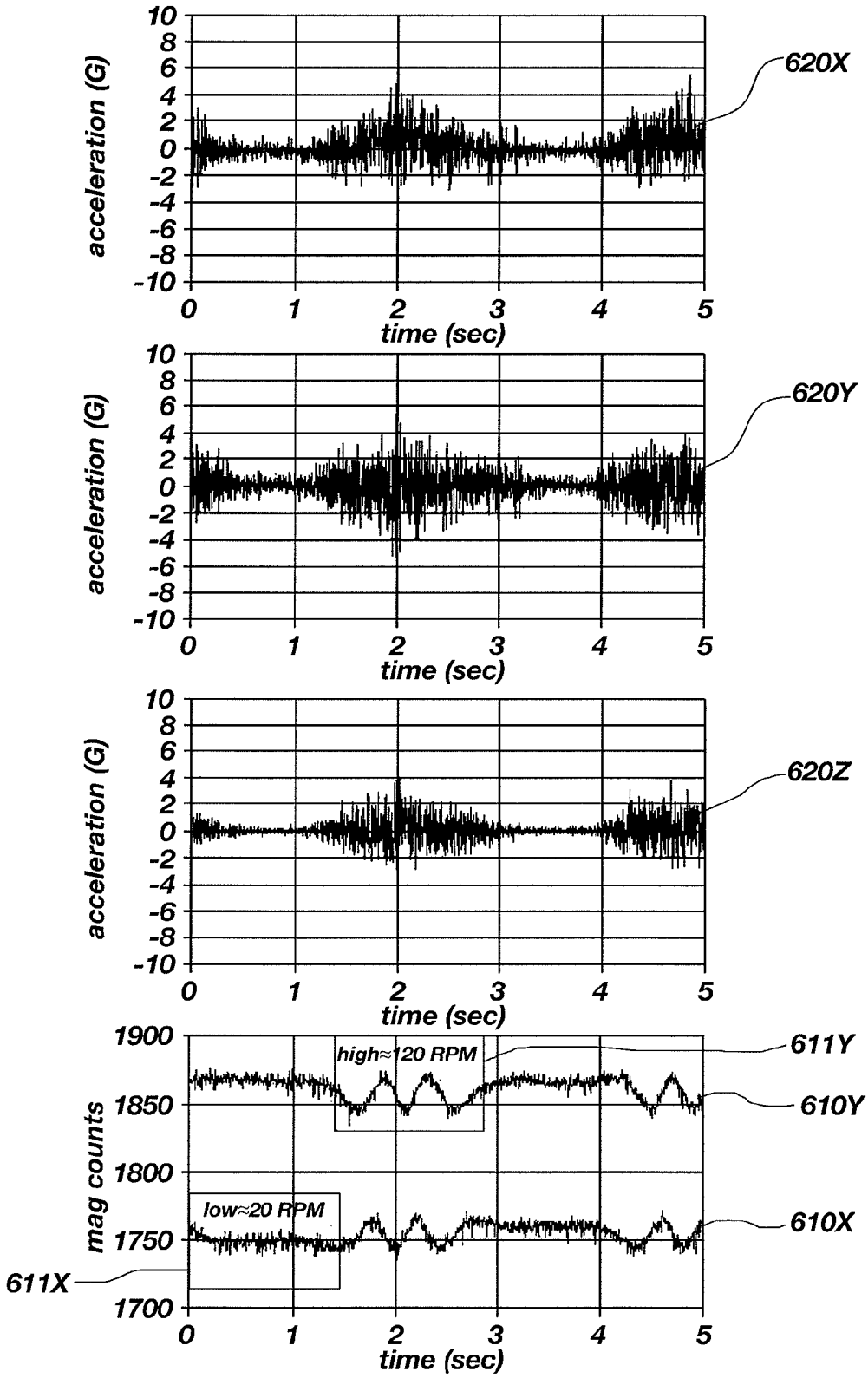
FIG. 9 illustrates examples of data sampled from accelerometer sensors and magnetometer sensors along three axes of a Cartesian coordinate system that is static with respect to the drill bit, but rotating with respect to a stationary observer.

FIG. 9 illustrates examples of types of data that may be collected by the data evaluation module 300 (FIG. 6). These figures illustrate an example of how accelerometer data (also referred to herein as acceleration information) and magnetometer data may appear during torsional oscillation. Initially, the magnetometer measurements 610Y and 610X illustrate a rotational speed of about 20 revolutions per minute (RPM) as shown by box 611X. This low RPM may be indicative of the drill bit binding on some type of subterranean formation. The magnetometer samples 610Y and 610X then illustrate a large increase in rotational speed, to about 120 RPM as shown by box 611Y. This high RPM may be indicative of the drill bit being freed from the binding force. This increase in rotation is also illustrated by the accelerometer measurements for radial acceleration 620X, tangential acceleration 620Y, and axial acceleration 620Z.

As stated earlier, the present invention includes methods and apparatuses to develop information related to cutting performance and condition of the drill bit. As non-limiting examples, the cutting performance and drill bit condition information may be used to determine when a drill bit is near its end of life and should be changed and when drilling operations should be changed to extend the life of the drill bit. The cutting performance and drill bit condition information from an existing drill bit may also be used for developing future improvements to drill bits.

Software, which may also be referred to as firmware, for the data evaluation module 300 (FIG. 6) comprises computer instructions for execution by the processor 320. The software may reside in an external memory 330, or memory within the processor 320.

As is explained more fully below with reference to specific types of data gathering, software modules may be devoted to memory management with respect to data storage. The amount of data stored may be modified with adaptive sampling and data compression techniques. For example, data may be originally stored in an uncompressed form. Later, when memory space becomes limited, the data may be compressed to free up additional memory space. In addition, data may be assigned priorities such that when memory space becomes limited high priority data is preserved and low priority data may be overwritten.

One such data compression technique, which also enables additional analysis of drill bit conditions, is converting the raw accelerometer data to Root Mean Square (gRMS) acceleration data. This conversion reduces the amount of data and also creates information indicative of the energy expended in each of the accelerometer directions. This expended energy may be used to estimate the work done by the cutting elements.

As is well known in the art, gRMS acceleration is the square root of the averaged sum of squared accelerations over time. As the data evaluation module collects acceleration samples it generates an acceleration history of acceleration over time. This acceleration history may be squared and then averaged to determine a mean-square acceleration over an analysis period. Thus, gRMS is the square root of the mean square acceleration. As used herein RMS acceleration and gRMS may be used interchangeably. In general, gRMS may be referred to herein as RMS acceleration to indicate the RMS acceleration at a specific point, or RMS acceleration history to refer to the collection of RMS acceleration over time. Furthermore, RMS acceleration history may generically refer to either or both RMS tangential acceleration history and RMS radial acceleration history.

The cutters 225 (FIG. 2) will dull over time as the drill bit cuts away material in the borehole. In general, the energy expended in the tangential direction is related to cutting, whereas energy expended in the radial direction is due to drilling dysfunction, wherein the drill bit may be bouncing against the walls of the borehole. As the cutters 225 dull, they will expend more energy to perform the same amount of cutting. In addition, as the cutters 225 dull, the drill bit may be more susceptible to dysfunctional states, such as bit whirl, bit walking, and lateral vibration, which will increase the amount of energy expended in the radial direction.

Figure 10A:
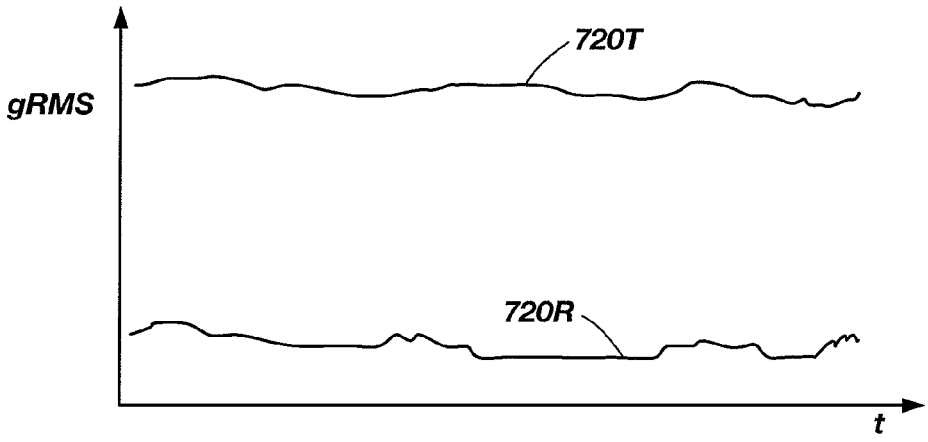
FIGS. 10A and 10B illustrate possible Root Mean Square (RMS) values for radial RMS acceleration and tangential RMS acceleration over relatively short periods of time.
Figure 10B:
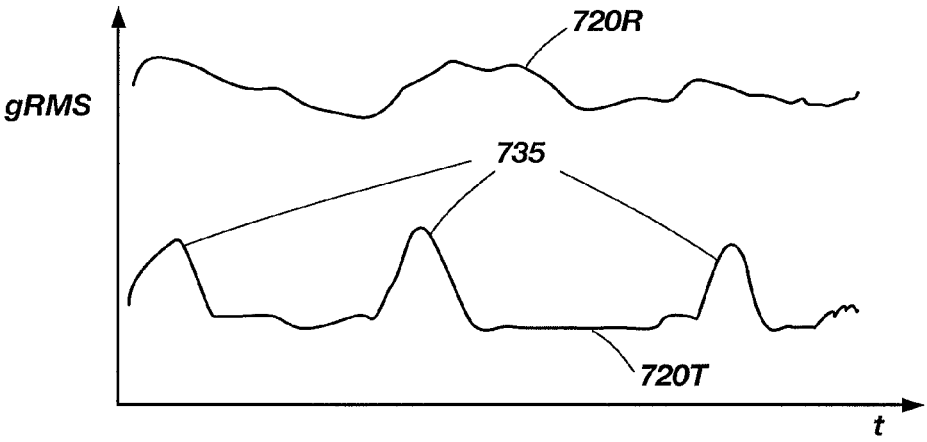

FIGS. 10A and 10B illustrate possible RMS values for RMS radial acceleration 720R and RMS tangential acceleration 720T over relatively short periods of time, for example, over a few minutes or hours. In FIG. 10A a tangential dominant state exists, wherein the RMS tangential acceleration 720T is significantly higher than the RMS radial acceleration 720R. A tangential dominant state generally indicates a good cutting action because most of the energy is expended in the tangential direction, i.e., cutting action, rather than in the radial direction.

FIG. 10B, on the other hand, indicates a radial dominant state, which may be indicative of a whirling or sliding action rather than a consistent cutting action. In the radial dominant state, the RMS radial acceleration 720R is near or larger that the RMS tangential acceleration 720T. The peaks 735 in the RMS tangential acceleration 720T may be indicative of points when the cutters 235 grab and some cutting occurs whereas the low areas between the peaks 735 may be indicative of when the drill bit is sliding or whirling.

Software modules may also be included to track the long-term history of the drill bit. Thus, based on drilling performance data gathered over the lifetime of the drill bit, a life estimate of the drill bit may be formed. Failure of a drill bit can be a very expensive problem. With life estimates based on actual drilling performance data, the software module may be configured to determine different states of cutting effectiveness and when a drill bit is nearing the end of its useful life. A result of this analysis may be communicated through the communication port 350 (FIG. 6) to external devices and a rig operator.

Figure 11:
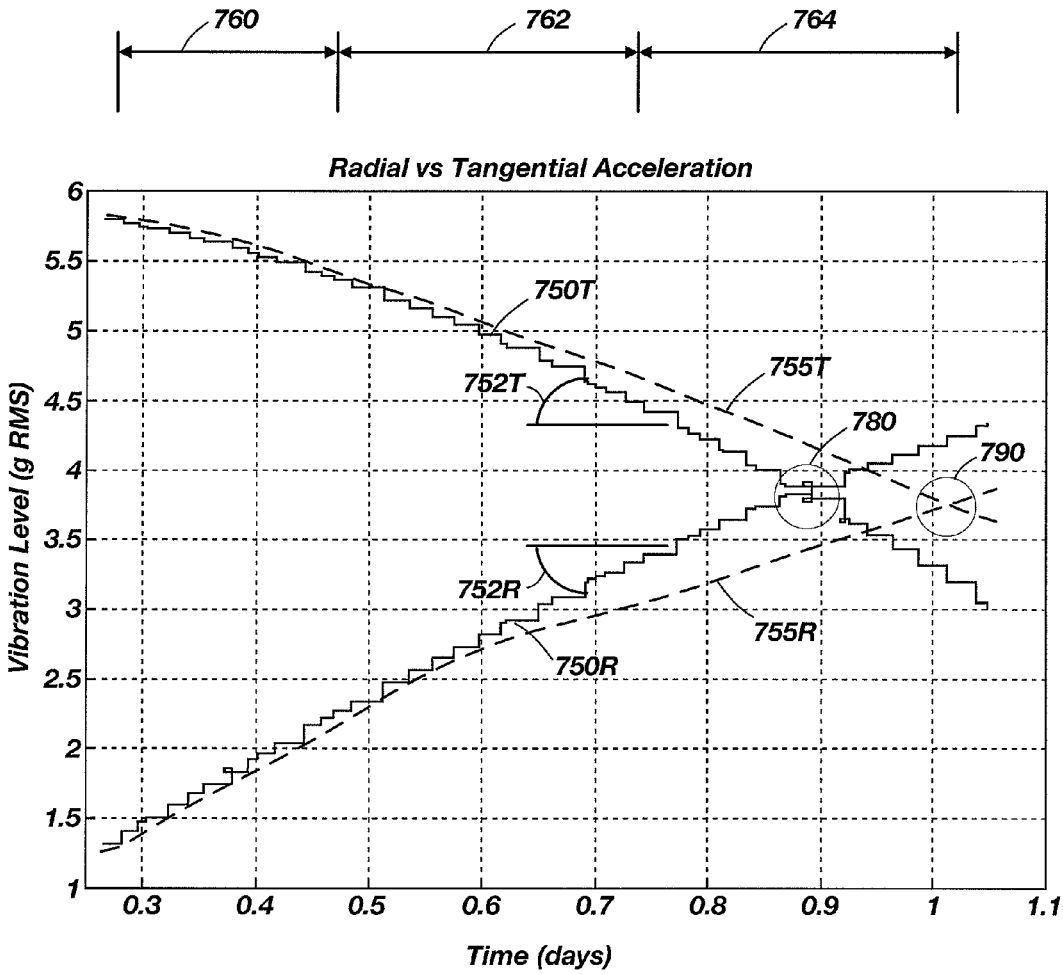
FIG. 11 illustrates possible RMS values for radial RMS acceleration and tangential RMS acceleration over a relatively long period of time.

FIG. 11 illustrates possible RMS values for RMS radial acceleration history 750R and RMS tangential acceleration history 750T over a relatively long period of time, for example, over the life of the drill bit. As can be seen by the RMS radial acceleration history 750R and RMS tangential acceleration history 750T, the energy expended in the tangential direction begins to fall and the energy expended in the radial direction begins to rise as the cutters dull. A cross point 780 may be determined where the RMS radial acceleration history 750R exceeds the RMS tangential acceleration history 750T. This cross point 780 may indicate a dull state for the drill bit, wherein it may be beneficial to pull and replace the drill bit to get more efficient cutting or before a catastrophic failure of the drill bit may occur. There might be instances prior to reaching this point, where the RMS radial acceleration might exceed the RMS tangential acceleration, which can be purely due to a change in drilling conditions (i.e., change in weight on bit, torque, entering a new formation type, etc., or a combination of those), but the overall trend is decreasing for the tangential direction and increasing for the radial direction.

At any given point along the acceleration histories, a slope may be defined for the RMS acceleration histories (750T and 750R). Thus, radial slope 752R defines a slope of the RMS radial acceleration history 750R at about 0.77 days. Similarly, tangential slope 752T defines a slope of the RMS tangential acceleration history 750T at about 0.77 days. A person of ordinary skill in the art will understand that these slopes may be determined at any point along the time axis to create a time-varying slope for the RMS accelerations, which may be either a time-varying radial slope or a time-varying tangential slope.

For ease of description, the life of the drill bit may be broken into three different states. A green state 760 is when the cutters are relatively sharp and the drill bit should cut effectively. An intermediate state 762 is when the cutters are beginning to dull, but the drill bit should still be performing adequately. A dull state 764 is when the cutters have significantly dulled and drill bit performance may no longer be adequate. As can be seen from FIG. 11, the time-varying radial slope 752R and the time-varying tangential slope 752T gradually change over time in a predictable manner. This change over time may be used to determine the current cutting effectiveness of the drill bit or when the drill bit has reached a dull state by analyzing the time-varying tangential slope 752T individually, analyzing the time-varying radial slope 752R individually, or analyzing the two time-varying slopes together.

In addition, the cross point 780 may be predicted ahead of time (using a curve fit routine, based on previous and current datapoints) by using a combination of the RMS tangential acceleration history 750T, the time-varying tangential slope 752T, the RMS radial acceleration history 750R, and the time-varying radial slope 752R.

The cutting effectiveness, dull state, or combination thereof, may be periodically reported to an operator on the surface via the communication port 350 (FIG. 6). The operator may wish to modify the drilling conditions based on the cutting effectiveness or dull state. As a non-limiting example, when cutting effectiveness diminishes, the operator may wish to prolong the life of the drill bit by modifying one or more drilling parameters such as, for example, torque, rotational velocity, and weight on bit. This modification may change the RMS acceleration histories to a modified RMS tangential acceleration history 755T and a modified RMS radial acceleration history 755R. With these modified acceleration histories, the cross point 780 may be pushed out to a later cross point 790, which may allow more time before the drill bit needs to be switched out. Of course, this drilling parameter modification may mean less energy is expended in drilling and the rate of penetration may decrease such that the depth drilled at cross point 790 may not be any deeper that the depth drilled at cross point 780. However, it would give the operator a means for extending the elapsed-time life of the drill bit in a case, for example, when another drill bit is not readily available to be switched in for the soon-to-be dull drill bit.

Figure 12A:
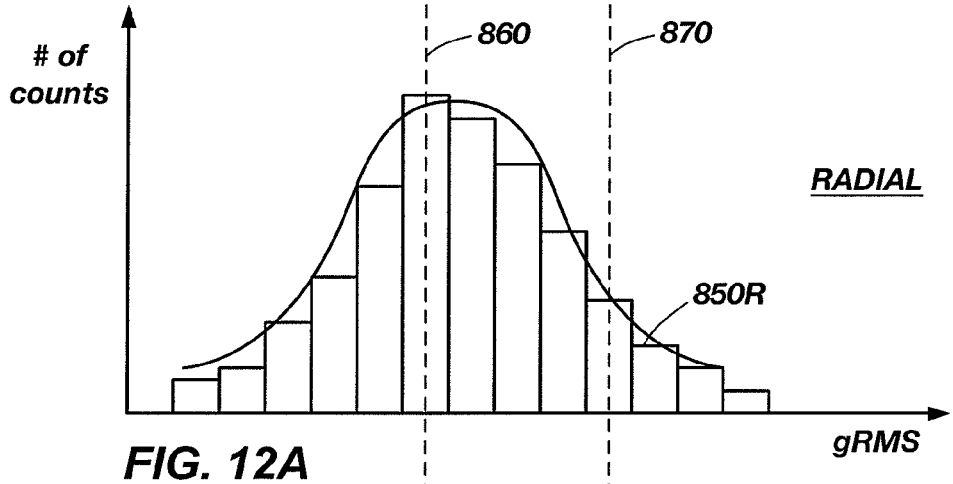
FIGS. 12A-12C illustrate histogram depictions of possible RMS values for radial, tangential, and axial accelerations, respectively.
Figure 12B:
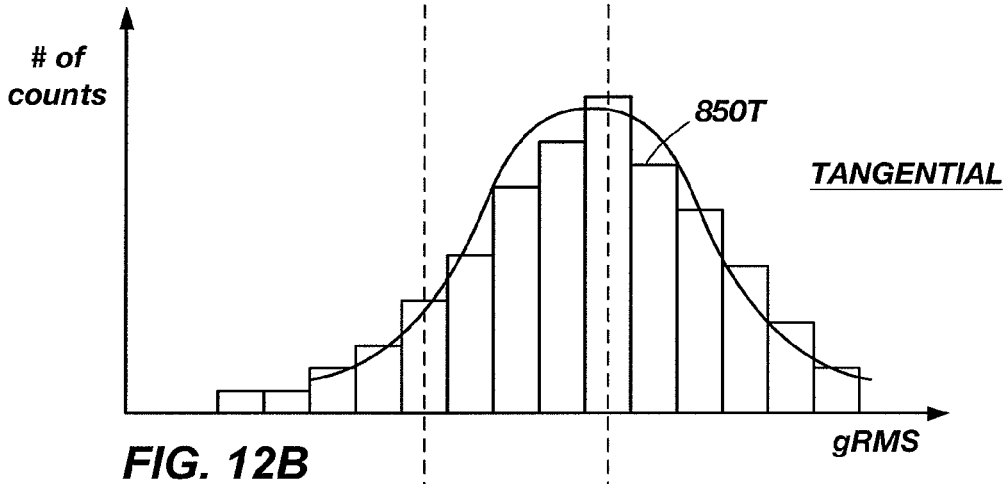
Figure 12C:
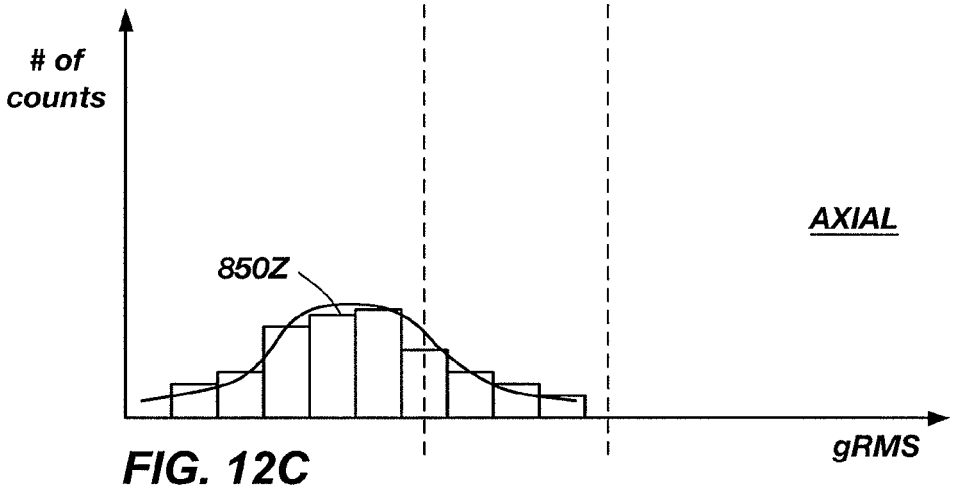

FIGS. 12A-12C illustrate histogram depictions of possible RMS values for radial, tangential, and axial accelerations, respectively. The histograms allow another method for analyzing cutting effectiveness and a dull state for the drill bit. A histogram plot will give a view of the number of sample points that had a specific RMS value. For example, at RMS acceleration point 860 (e.g., 2 Gs), the radial RMS histogram 850R shows 50 sample points, the tangential RMS histogram 850T shows twenty sample points and the axial RMS histogram 850Z shows five sample points. Similarly, at RMS acceleration point 870 (e.g., 3 Gs), the radial RMS histogram 850R shows fifteen sample points, the tangential RMS histogram 850T shows forty-five sample points and the axial RMS histogram 850Z shows zero sample points.

Thus, at the point in time where the histograms of FIGS. 12A-12C are generated, it can be seen that the mean RMS value for the tangential acceleration is higher than the mean RMS value for the radial acceleration, indicating that the drill bit is cutting effectively. Over time, additional histograms may be created. As time passes, and the drill bit dulls, newly generated histograms with additional information will slide along the x-axis (i.e., RMS-axis). In general, as the drill bit dulls, the radial RMS histogram 850R will slide toward the right (higher RMS values) and the tangential RMS histogram 850T will slide toward the left (lower RMS values). Thus, by analyzing the histograms over time, green states, effective cutting states, and dull states may be determined. For example, as the tangential RMS histogram 850T slides left and the radial RMS histogram 850R slides right, the analysis can determine a state where the tangential RMS acceleration is high enough relative to the radial RMS acceleration to indicate a dull state.

While the present invention has been described herein with respect to certain preferred embodiments, those of ordinary skill in the art will recognize and appreciate that it is not so limited. Rather, many additions, deletions, and modifications to the preferred embodiments may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. A drill bit for drilling a subterranean formation, comprising:

a bit body bearing a plurality of cutting elements and a shank extending from the bit body and adapted for coupling to a drillstring;

an annular chamber formed within the shank;

a set of accelerometers disposed in the drill bit and comprising a radial accelerometer for sensing radial acceleration of the drill bit and a tangential accelerometer for sensing tangential acceleration of the drill bit; and a data evaluation module disposed in the annular chamber and comprising a processor, a memory, and a communication port, the data evaluation module configured for performing a bit acceleration analysis, comprising:

sampling acceleration information from the radial accelerometer and the tangential accelerometer over an analysis period;

storing the acceleration information in the memory to generate an acceleration history;

analyzing the acceleration history to determine a cutting effectiveness of the plurality of cutting elements responsive to changes in the acceleration history; and reporting the cutting effectiveness through the communication port.

2. The drill bit of claim 1, wherein the analyzing the acceleration history comprises determining a cross point when a Root Mean Square (RMS) radial acceleration will exceed a RMS tangential acceleration, and wherein the reporting the cutting effectiveness comprises reporting the cross point as a dull state.

3. The drill bit of claim 1, wherein the analyzing the acceleration history comprises determining a slope of a RMS radial acceleration history over the analysis period, and wherein the reporting the cutting effectiveness comprises reporting a current slope of the RMS radial acceleration history.

4. The drill bit of claim 3, wherein the data evaluation module is further configured for storing the RMS radial acceleration history in the memory.

5. The drill bit of claim 1, wherein the analyzing the acceleration history comprises determining a slope of a RMS tangential acceleration history over the analysis period, and wherein the reporting the cutting effectiveness comprises reporting a current slope of the RMS tangential acceleration history.

6. The drill bit of claim 5, wherein the data evaluation module is further configured for storing the RMS tangential acceleration history in the memory.

7. The drill bit of claim 5, wherein the analyzing the acceleration history comprises determining a slope of a RMS radial acceleration history over the analysis period, and wherein the reporting the cutting effectiveness comprises reporting a current slope of the RMS radial acceleration history.

8. The drill bit of claim 7, wherein the data evaluation module is further configured for:

periodically generating histogram information of the RMS tangential acceleration history and the RMS radial acceleration history; and analyzing the histogram information to determine the cutting effectiveness responsive to relative alignment of a radial RMS histogram relative to a tangential RMS histogram.

9. The drill bit of claim 8, wherein the cutting effectiveness is determined as a dull state when a mean radial RMS from the radial RMS histogram is larger than a mean tangential RMS from the tangential RMS histogram.

10. A method, comprising:

periodically collecting sensor data by sampling over an analysis period at least one tangential accelerometer disposed in a drill bit and at least one radial accelerometer disposed in the drill bit;

processing the sensor data in the drill bit to develop a Root Mean Square (RMS) radial acceleration history and a RMS tangential acceleration history;

comparing the RMS radial acceleration history and the RMS tangential acceleration history to determine a cross point when the RMS radial acceleration history will exceed the RMS tangential acceleration history; and reporting the cross point as a dull state.

11. The method of claim 10, further comprising modifying a drilling parameter responsive to the reporting the cross point, wherein the drilling parameter is selected from the group consisting of torque, rotational velocity, and weight on bit.

12. The method of claim 10, further comprising:

analyzing the RMS radial acceleration history to determine a time-varying radial slope; and reporting a cutting effectiveness correlated to the time-varying radial slope.

13. The method of claim 10, further comprising:

analyzing the RMS tangential acceleration history to determine a time-varying tangential slope; and reporting a cutting effectiveness correlated to the time-varying tangential slope.

14. The method of claim 10, further comprising storing the RMS radial acceleration history and the RMS tangential acceleration history in a memory disposed in the drill bit.

15. The method of claim 10, further comprising:

periodically generating histogram information of the RMS tangential acceleration history and the RMS radial acceleration history; and analyzing the histogram information to determine a cutting effectiveness responsive to relative alignment of a radial RMS histogram relative to a tangential RMS histogram.

16. The method of claim 15, wherein the cutting effectiveness is determined as the dull state when a mean radial RMS from the radial RMS histogram is larger than a mean tangential RMS from the tangential RMS histogram.

17. A method, comprising:

collecting acceleration information by periodically sampling over an analysis period a set of accelerometers disposed in the drill bit comprising a radial accelerometer for sensing radial acceleration of the drill bit and a tangential accelerometer for sensing tangential acceleration of the drill bit;

in the drill bit:

storing the acceleration information in a memory;

processing the acceleration information to develop a Root Mean Square (RMS) acceleration history;

analyzing the RMS acceleration history to determine a time-varying slope of the RMS acceleration history over the analysis period;

determining a cutting effectiveness of a plurality of cutting elements borne by the drill bit, wherein the cutting effectiveness is correlated to a slope of the time-varying slope; and reporting the cutting effectiveness through a communication port in the drill bit.

18. The method of claim 17, further comprising modifying a drilling parameter responsive to the cutting effectiveness reported, wherein the drilling parameter is selected from the group consisting of torque, rotational velocity, and weight on bit.

19. The method of claim 17, wherein reporting the cutting effectiveness is performed periodically to indicate a time-varying cutting effectiveness of the drill bit.

20. A method, comprising:

collecting acceleration information from a radial accelerometer and a tangential accelerometer disposed in a drill bit by periodically sampling the radial accelerometer and the tangential accelerometer over an analysis period;

processing the acceleration information in the drill bit to develop a Root Mean Square (RMS) tangential acceleration history and a RMS radial acceleration history; and analyzing the RMS acceleration history to determine a time-varying slope of the RMS acceleration history over the analysis period;

reporting a cutting effectiveness of the drill bit correlated to the time-varying slope;

determining a cross point when the RMS radial acceleration history will exceed the RMS tangential acceleration history; and reporting the cross point.

21. The method of claim 20, further comprising modifying a drilling parameter responsive to the reporting the cross point, wherein the drilling parameter is selected from the group consisting of torque, rotational velocity, and weight on bit.

22. The method of claim 20, further comprising:

periodically generating histogram information of the RMS tangential acceleration history and the RMS radial acceleration history; and analyzing the histogram information to determine the cutting effectiveness responsive to relative alignment of a radial RMS histogram relative to a tangential RMS histogram.

23. The method of claim 22, wherein the cutting effectiveness is determined as a dull state when a mean radial RMS from the radial RMS histogram is larger than a mean tangential RMS from the tangential RMS histogram.

* * * * *